United States Patent [19]

Buckholtz, Jr.

[11] 4,027,874

[45] June 7, 1977

[54] NOVELTY ITEM

[76] Inventor: Theonda N. Buckholtz, Jr., 113 Sigma St., Apt. 2, Belle Chasse, La. 70037

[22] Filed: July 23, 1975

[21] Appl. No.: 598,212

[52] U.S. Cl. ..... 272/1 R; 85/1 K; 151/41.7

[51] Int. Cl.[2] ..... A63B 71/00

[58] Field of Search ..... 272/1 R, 8 R, 8 D, 8 N; 273/1 R, 1 C, 56, 57, 127 D, 176 AA, 184 A; 46/237; 85/1 H, 1 K, 9 R; 81/13; 151/69, 41.7; 248/62, 342, 341; 58/129, 132, 134

[56] References Cited

UNITED STATES PATENTS

| | | | |
|---|---|---|---|
| 168,217 | 9/1875 | Blake | 248/62 X |
| 336,498 | 2/1886 | Spencer | 248/341 |
| 620,872 | 3/1899 | Park | 85/9 R X |
| 938,662 | 11/1909 | Graham | 85/9 R X |
| 1,647,992 | 11/1927 | Hartman | 85/9 R X |
| 2,010,853 | 8/1935 | Dyer | 85/1 K X |
| 2,277,672 | 3/1942 | Stone | 46/237 |
| 3,019,887 | 2/1962 | Lowden | 85/9 R X |
| 3,427,731 | 2/1969 | Debolt | 35/22 R X |

FOREIGN PATENTS OR APPLICATIONS

| | | | |
|---|---|---|---|
| 22,844 | 10/1909 | United Kingdom | 273/56 |

*Primary Examiner*—Richard C. Pinkham
*Assistant Examiner*—Arnold W. Kramer
*Attorney, Agent, or Firm*—Calvin J. Laiche

[57] ABSTRACT

The present invention provides a novelty item comprising a base member which is affixed to a U-shaped structure. The U-shaped structure is inverted whereby the terminal ends of the U-shaped structure are attached to and rigidly affixed to the base member in a perpendicular relationship whereby the mid section of the U-shaped member is suspended above the base member at a distance essentially equal to that of the leg portions of the U-shaped member. A conventional bolt is rotatably suspended from the mid section of the U-shaped member by virtue of an eyelet rigidly affixed to the head of the bolt member whereby the bolt is vertically suspended upon the midsection of the U-shaped member during its normal at rest position. The bolt member is in turn provided with a standard nut member so as to form a standard nut and bolt assembly.

Another embodiment of the instant invention is directed to a base member having an upright threaded shaft portion which is in turn provided with a standard nut member. The base member is also provided with a name tag reading "GO AHEAD AND SCREW IT UP" as is the preferred embodiment described above.

4 Claims, 5 Drawing Figures

NOVELTY ITEM

BACKGROUND OF THE INVENTION

The instant invention relates generally to novelty items, and more particularly to a novelty item which in effect creates a puzzlement to the observer as to its intended and apparent function and purpose.

Novelty items are old in the art and generally such devices are obvious from their materials of construction and/or their particular manner of construction. The present invention provides a novelty item which is made of certain standard materials of construction as conventionally observed in an industrial plant, machine shop or the like, however, are arranged physically so as to appear to perform a possible mechancial purpose, however, in effect creates a puzzlement to the observer. The primary object of the present invention is to provide such a novelty item which at first blush appears to be a mechanical contrivance having a possible definite industrial application, however, in effect constitutes a novelty item in light of the obvious operational relationship between certain of its components which can be readily operated in the conventional manner by the observer who when informed or observes the title inscribed on the present novelty item, can then appreciate the amusement and object of the present device.

DESCRIPTION OF THE DRAWINGS

The above objects, together with other features and advantages of the instant invention will be apparent to one skilled in the art in light of the details of construction and operation of the present novelty item as shown in the drawing and described in the ensuing detailed disclosure of its preferred embodiments which are particularly pointed out in the appended claims. In the drawing illustrating the preferred embodiment of the present invention, synonymous reference numerals are employed throughout in the various views to refer to identical components.

DESCRIPTION OF THE PREFERRED EMBODIMENT

Figure 1:
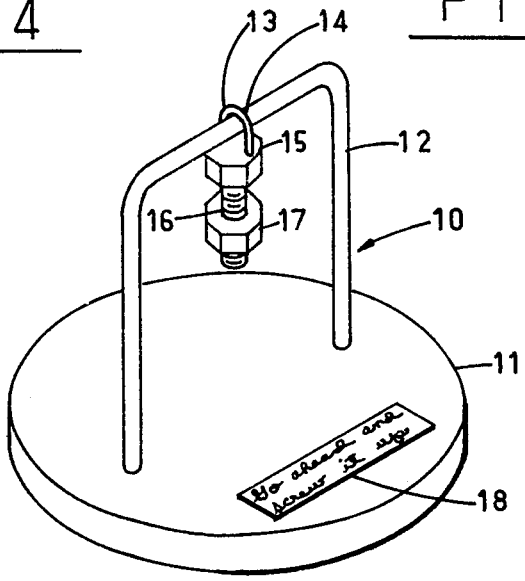
FIG. 1 in the drawing depicts an isometric view of the present novelty item as shown in its normal upright operational position.
Figure 2:
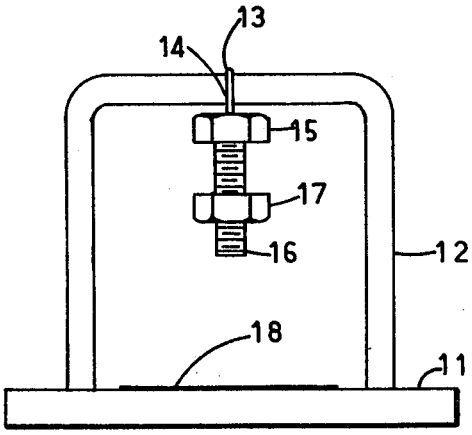
FIG. 2 in the drawing represents a front elevation view of the present novelty item.
Figure 3:
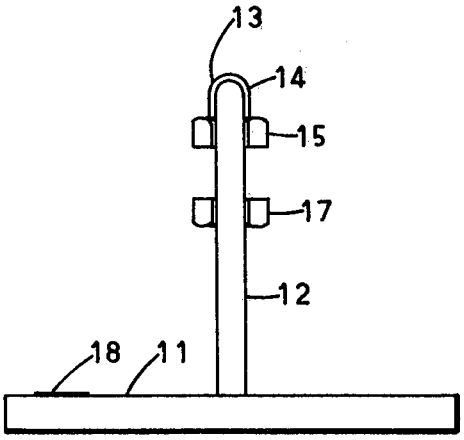
FIG. 3 in the drawing represents a side elevation view of the present novelty item.

Referring to FIG. 1 in the drawing, the present novelty item 10 comprises the base member 11 which can comprise any material of construction, as well as any shape. Generally, a circular member as shown in FIG. 1 is preferred, however, it can be appreciated that the member 11 can be square, hexagonal, or the like. The base member 11 can also be of any suitable thickness, the dimensions thereof primarily being dependent upon the overall esthetic result sought.

The inverted U shaped member 12 is rigidly affixed to the base member 11 in any suitable form or fashion. Where the members 11 and 12 are fabricated of metal, generally these members are welded together, or the member 11 bored to receive the extended arm portions of the U shaped member 12 which are sized to be force fitted within such bore holes. From an economic viewpoint, the members 11 and 12 are generally made of a plastic material resembling metal and in that instance, they can be readily glued together in a suitable form or fashion.

The inverted U shaped member 12 is attached essentially in the center of the base member 11 and is oriented vertically essentially perpendicular to the base member 11. The U shaped member 12 in turn is provided with the suspended bolted nut assembly 13. The assembly 13 is further defined as comprising the U shaped suspension member 14 which is of a similar shape and configuration as the member 12, however, preferably having its central portion rounded unlike the member 12 which is flat across its central portion. The U shaped member 14 in turn is rigidly affixed to the bolt 15 which can comprise a conventional bolt being provided with the threaded portion 16. The bolt 15 is further provided with the nut 17 so as to constitute a standard bolt and nut assembly as commonly utilized and seen in industry. Of course, while a hex head bolt and nut assembly is shown in the drawings, any form of bolt and nut assembly can be employed, for example, a round headed bolt 15 and mating nut, a square headed stove bolt assembly, or so forth.

The members 14, 15 and 17 are likewise preferably fabricated of metal, however, a plastic material resembling metal can easily be employed.

In their operable position as shown in FIG. 1 in the drawing, the assembly 13 is suspended from the flat midsection of the inverted U shaped member 12 where it is normally allowed to remain during the normal use of the present novelty item. By such an arrangement, the observer is naturally provoked or at least induced to feel that the structure as shown would obviously have a definite industrial intended purpose. However, upon closer observation of the name plate 18, which is inscribed with the saying "GO AHEAD AND SCREW IT UP", it thus becomes apparent that the device has some amusement value. Generally, the average person would more than apt grab hold of the nut and bolt assembly 13 and manipulate it, that is, screwing the nut 17 up and down on the threaded portion 16 of the bolt 15. At that point, the user would then observe the name tag and realize the intended purpose of the present device. For that reason, the name tag 18 generally is not made too large so as to initially attract the observer's attention, that is, it is intended that he first fix his thoughts upon the nut and bolt assembly 13 in an attempt to figure out its purpose.

Figure 4:
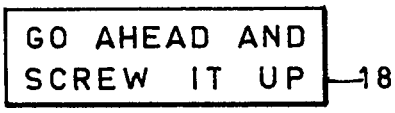
FIG. 4 in the drawing depicts an isolated plan view of the name tag to be inserted on the base member in the relative position as shown in FIG. 1.
Figure 5:
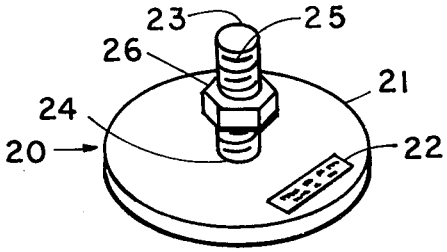
FIG. 5 in the drawing depicts an isometric view of another preferred embodiment of the instant invention.

FIG. 5 in the drawing represents yet another preferred embodiment of the present invention wherein the novelty item 20 further comprises the base member 21 which can be of any shape and material as in the case of the embodiment of FIG. 1. The base member 21 is also provided with the name tag 22 which reads "GO AHEAD AND SCREW IT UP". The threaded member or stud bolt 23 is mounted in the center of the base member 21 and serves a similiar purpose as that of the bolt member 16 of FIG. 1. The threaded member 23 is mated with the nut 26 which screws down on the threads 25 of the threaded member 23 and thus serves a similiar function as the threaded assembly 15 of FIG. 1. The member 23 is shown mounted in the center 24 of the base member 21, however, it can be located elsewhere on the base 21.

It will be apparent to one skilled in the art that various changes and modifications can be made in the above device without departing from the true scope and spirit of the present invention. For example, the relative structural arrangements between the components thereof can be changed, for example, the U shaped member 12 could be located at the rear portion of the base member 11. Additionally, the U shaped member could be made relatively much taller, and/or of a somewhat different configuration as long as the nut and bolt assembly 13 could be readily retained in a suspended position as shown in the drawing. In light of the above, it is thus apparent to one skilled in the art that many modifications can be made in the instant invention and what I intend to accomplish within the ambit of my invention is that as set forth and particularly pointed out in the appended claims.

What I claim as invention is:

1. A novelty item comprising:

a. base means;

b. stanchion means comprising a U shaped member rigidly affixed in an inverted position to said base means, being oriented essentially perpendicular thereto; and c. a threaded bolt and nut assembly comprising a conventional threaded bolt member having a U shaped member in turn rigidly affixed to its head portion and adapted to receive and bayonet upon said U shaped upright stanchion member along its mid portion.

2. The novelty item of claim 1 further characterized in that said base means in claim 1 is circular in design.

3. The novelty item of claim 2 further characterized in that said base means is provided with the inscription "GO AHEAD AND SCREW IT UP".

4. The novelty item of claim 3 further characterized in that said U shaped stanchion means is further defined as comprising a square U-shaped member having a flat midsection from which said nut and bolt assembly is operably suspended.

* * * * *